US005980603A

United States Patent [19]

Thomas et al.

[11] Patent Number: 5,980,603

[45] Date of Patent: Nov. 9, 1999

[54] FERROUS POWDER COMPOSITIONS CONTAINING A POLYMERIC BINDER-LUBRICANT BLEND

[75] Inventors: Yannig Thomas, Montreal; Sylvain Pelletier, Ste Julie; Claude Gelinas, Tracy, all of Canada

[73] Assignee: National Research Council of Canada, Ottawa, Canada

[21] Appl. No.: 09/080,307

[22] Filed: May 18, 1998

[51] Int. Cl.[6] ..... C22C 1/00

[52] U.S. Cl. ..... 75/252; 75/255

[58] Field of Search ..... 75/252, 231, 255; 252/62.53, 62.55

[56] References Cited

U.S. PATENT DOCUMENTS

| | | | |
|---|---|---|---|
| 2,783,208 | 2/1957 | Katz | 252/62.5 |
| 3,125,544 | 3/1964 | Winslow et al. | 260/43 |
| 5,268,140 | 12/1993 | Rutz et al. | 419/54 |
| 5,290,336 | 3/1994 | Luk | 75/231 |
| 5,368,630 | 11/1994 | Luk | 75/252 |
| 5,498,276 | 3/1996 | Luk | 75/252 |

FOREIGN PATENT DOCUMENTS 58-222504 12/1983 Japan .

OTHER PUBLICATIONS

Gélinas et al., Iron–Resin Composites . . . , Advances in Powder Metallurgy & Particul Materials –1997, pp. 1–37.

Jansson et al, Powdered Soft Magnetic Materials . . . Soft Magnetic Materials 96, Feb. 26–28, 1996.

Katime et al, Hydrogen–Bonded Blends, The Polymeric Materials Encyclopedia 1996, CRC Press, Inc.

Acid–Base Interactions, Encyclopedia of Polymer Scienee & Engineering, John Wiley & Sons, 1985 Suppl. Volume.

*Primary Examiner*—Ngoclan Mai
*Attorney, Agent, or Firm*—J. Szereszewski

[57] ABSTRACT

Complexable polymeric binder-lubricant blends are disclosed for production by powder metallurgy techniques of ferrous compositions with remarkably high green strength upon compaction, or soft magnetic ferrous powder/resin composites with improved processability and magnetic properties. An exemplary composition consists of a ferrous powder, a thermoset phenolic resin and poly(ethylene oxide), both polymers exhibiting, when intimately mixed, strong intermolecular acid-base interactions giving rise to an interpolymer complex which imparts a high strength to the resulting ferrous powder compact.

18 Claims, No Drawings

FERROUS POWDER COMPOSITIONS CONTAINING A POLYMERIC BINDER-LUBRICANT BLEND

FIELD OF THE INVENTION

The present invention relates to ferrous powder compositions containing specific polymeric binder-lubricant blends which can give rise to an association product, also known as interpolymer complex, by strong intermolecular acid-base interactions. Such compositions can be used to produce remarkably high green strength compacts or/and soft magnetic composites with improved processability and magnetic properties, together with good mechanical properties.

BACKGROUND OF THE INVENTION

The Processes for producing metal parts from ferrous powders using powder metallurgy (P/M) techniques are well known. Such techniques typically involve mixing of ferrous powders with alloying components such as graphite, copper or nickel in powder form, filling the die with the powder mixture, compacting and shaping of the compact by the application of pressure, and ejecting the compact from the die. The compact is then sintered wherein metallurgical bonds are developed by mass transfer under the influence of heat. The presence of an alloying element enhances the strength and other mechanical properties in the sintered part compared to the ferrous powders alone. When necessary, secondary operations such as sizing, coining, repressing, impregnation, infiltration, machining, joining, etc. are performed on the P/M part.

It is common practice to use a lubricant for the compaction of the ferrous powder. The lubricant can be admixed with the ferrous powders or sprayed onto the die wall before the compaction. The lubricant is used to improve the compressibility of ferrous powders and the uniformity of densification throughout the part. It also reduces the metal powder/die wall friction, and in turn lowers the ejection force that is required to remove the compact from the die, thus minimizing die wear.

Die-wall lubrication is known to lead to compacts with high green strength. Indeed, die-wall lubrication enables mechanical anchoring and metallurgical bonding between particles during compaction. However, die-wall lubrication is not yet widely used because it increases the compaction cycle time, leads to less uniform densification and is not applicable to complex shapes. On the other hand, an admixed lubricant most often reduces the strength of the green compact by forming a lubricant film between the metal particles which limits microwelding and eases the slipping of the particles when stresses are applied.

When complex parts or parts with thin walls are to be produced, as well as when green parts have to be machined, parts with a high green strength are required. A number of patents describe lubricating components leading to compacts with enhanced green strength compared with conventional lubricants such as synthetic waxes and metallic stearates. For example, in U.S. Pat. No. 5,290,336 Luk discloses iron-based powder compositions containing binder-lubricants which increase the strength of green compacts, in terms of transverse rupture strength (TRS) values, up to about 5,000 psi, and which generally reduce the ejection forces during removal of the compacted part from the die cavity. The binder-lubricants comprise a dibasic organic acid and one or more additional components such as solid polyethers, liquid polyethers, and acrylic resins. Such binder-lubricants are added to the iron-based powders preferably in liquid form, dissolved or dispersed in an organic solvent. In U.S. Pat. No. 5,498,276, Luk discloses the use of a polyether or poly(alkylene oxide) in a particulate form as a green strength enhancing lubricant. Green compacts with transverse rupture strength values of about 6,000–7,000 psi are obtained. However, dimensional variations during sintering are higher compared to mixes containing conventional lubricants, which may alter the sintered properties.

Non-sintered soft magnetic parts especially for AC magnetic applications can also be produced using P/M techniques. In this case, the iron-based powder compositions contain an organic dielectric resin which forms an insulating coating between the iron particles and also bind those particles so as to impart mechanical strength to the pressed parts. A wide range of thermoset or thermoplastic resins have been described for the production of such magnetic composites, alone or in conjunction with inorganic insulating coatings, as diclosed for example in U.S. Pat. No. 5,268,140 (Rutz et al.), or European Patent 583,808 (Gay). Different techniques have been used to electrically insulate particles, as disclosed in U.S. Pat. No. 5,211,896 (Ward et al.). Among them, wet techniques, which employ soluble resins, have most often been used to obtain a uniform coating at the surface of the iron particles for high frequency applications. On the other hand, it has been shown that by dry mixing iron and phenolic resin powders and compacting the mix using die wall lubrication, magnetic parts with good permeability and low losses (especially eddy current losses) at frequencies up to 50–100 kHz could be easily obtained. After compaction, compacts are heated at temperatures between 100° C. and 300° C. to crosslink the thermoset resin. The resin has such a low viscosity that it flows inside the compact at the very beginning of the curing treatment to wet, bind and isolate the iron particles. Good mechanical properties, i.e., TRS values as high as 17,000–20,000 psi were obtained.

Even if die wall lubrication can be used to enable the production of soft magnetic iron/resin composites, it is often preferable that the iron-based powder compositions contain an admixed lubricant to improve the processability of such magnetic materials in an industrial environment. Standard known lubricants are, e.g., zinc stearate, amide wax, stearic acid or PTFE, as well as boron nitride for warm compaction at temperatures higher than 250° C. Even if they improve most often the processability of iron/resin powder mixtures, they decrease the strength of pressed parts significantly. There is thus a need for a lubricated powder composition that will give rise to improve processability of soft magnetic composites, while maintaining their good magnetic and mechanical properties.

SUMMARY OF THE INVENTION

It is an object of the invention to provide ferrous powder compositions containing specific polymeric binder-lubricant blends which can give rise to an association product, also known as interpolymer complex, by strong intermolecular acid-base interactions. Such binder-lubricant blends may be dry mixed in powder form with ferrous powders, or dissolved and sprayed on the surface of ferrous powders.

It is also an object of the present invention to provide ferrous powder compositions which when formed by P/M techniques give parts with a high green strength and improved sintered properties.

It is further an object of the present invention to provide such lubricated ferrous powder compositions that can also be used to produce non-sintered soft magnetic composites, especially for AC magnetic applications, with improved processability and magnetic properties, together with good mechanical strength.

In accordance with the invention, there is provided a metallurgical powder composition comprising a metallic powder and a polymeric blend comprising a binder and a lubricant, the amount of the polymeric blend being from about 0.1 wt. % to about 20 wt. % of the composition, the binder and the lubricant being selected such that they form an association product by strong intermolecular acid-base interactions when mixed with each other, whereby the green strength of the powder composition, when compacted, exceeds 5000 psi, preferably 8,000 psi.

Typically, the metallic powder is a ferrous powder such as an iron or iron-based material. The composition may further contain, for certain applications, an alloying powder in the amount of up to 15 wt. % of said composition. The alloying powder may be, for example, one or more of the following: graphite, copper, nickel and ferro-alloys.

Typically, the binder is a thermoset or thermoplastic polymer having a strong acid character such as phenolic resins or carboxylic polyacids (for example, polymethacrylic acid and copolymers, hydrolyzed or monoester maleic anhydride copolymers).

In a specific embodiment of the invention, the lubricant is a polymer having a strong basic character, such as poly (alkylene oxide) having the general formula $$-[O(CH_2)_x]_y-$$

where x is from 1 to about 7. Preferably, the poly(alkylene oxide) is a poly(ethylene oxide) with x=2 and y is selected such that the poly(ethylene oxide) has a weight average molecular weight from about 5,000 to about 8,000,000 and more preferably below 400,000.

Alternatively, the lubricant is a polymer having also a strong basic character, such as a poly(alkylene ester) having the formula $$-[O(CH2)_xO-C(O)-(CH2)_y-C(O)-]_n-$$

$$\text{or } -[O(CH2)_z-C(O)-]_n$$

for instance

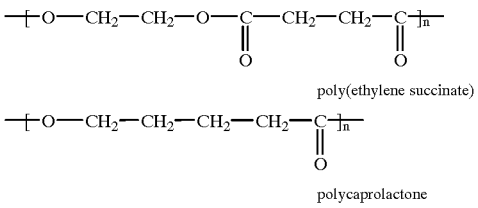

where x, y or z is from 1 to about 18 and n is such that said poly(alkylene ester) is solid at room temperature, for example a polycaprolactone (z=5) having a number average molecular weight from about 43,000 to about 80,000.

The compositions of the present invention are preferable to those described in the U.S. Pat. Nos. 5,290,336 and 5,498,276 in that higher green strength together with better sintered properties can be obtained.

DETAILED DESCRIPTION OF THE INVENTION

The metallurgical powder compositions of the invention comprise a mixture of metal powders having a maximum particle size of generally about 600 microns. Optionally, an alloying powder in the amount of less than 15 weight percent can be admixed. The compositions include a blend of polymeric binder and lubricant, which can give rise to an association product or interpolymer complex by strong intermolecular acid-base interactions. The binder may be a thermoset or thermoplastic polymer having a strong acid character such as phenolic resins or carboxylic polyacids. The lubricant may be a polymer with a strong basic character such as a poly(alkylene oxide), e.g. poly(ethylene oxide), or a poly(alkylene ester) e.g. polycaprolactone.

Using these metallurgical compositions, it has been found that compacts with remarkably high green strength can be produced together with sintered properties superior or equivalent to those obtained from metallurgical compositions containing other lubricants. Such lubricated ferrous powder compositions can also be used to produce non-sintered soft magnetic composites, especially for AC magnetic applications, with improved processability and magnetic properties, together with a good mechanical strength.

The ferrous powders employed in the present invention are any of the pure iron or iron-containing (including steel or ferromagnetic) powders generally used in P/M methods. Essentially any ferrous powder having a maximum particle size less than about 600 microns can be used in the composition of the invention.

Typical ferrous powders are iron and steel powders including stainless steel and alloyed steel powders. Atomet® 1001 steel powders manufactured by Quebec Metal Powders Limited of Tracy, Quebec, Canada are representative of such iron and steel powders. These Atomet® powders contain in excess of 99 weight percent iron, less than 0.2 weight percent oxygen and 0.1 weight percent carbon, and have an apparent density of 2.50 g/cm$^3$ and a flow rate of less than 30 seconds per 50 g. Virtually any grade of steel can be used.

Considering the production of soft magnetic composites, typical ferrous powders are preferably high purity iron powders, preferably at least 97% pure, more preferably at least 99% pure, and most preferably at least 99.75% pure. Suitable iron powders are commercially available. For example, Quebec Metal Powders Limited of Tracy, Quebec, Canada manufactures and markets a number of high purity iron powders, including Atomet® 1001 HP, Atomet® 110HP and Atomet® 68. Those skilled in the art will readily be able to identify alternative suitable iron powders.

In accordance with the present invention, the metal powder is admixed with a polymeric binder-lubricant blend. The blend comprises a polymeric lubricant with a strong basic character such as poly(alkylene oxide), or poly(alkylene ester).

The poly(alkylene oxide) for the purposes of the present invention has the following general formula:

$$-[O(CH2)_x]_y-$$

wherein x is from about 1 to about 7 and y is selected such that the poly(alkylene oxide) has a weight average molecular weight greater than 5,000. Preferably, the poly(alkylene oxide) is a poly(ethylene oxide) with x=2, and y is selected such that the poly(alkylene oxide) has a weight average molecular weight from about 5,000 to about 8,000,000, more preferably below 400,000. Commercially suitable poly (ethylene oxide) is for instance POLYOX®N-10 available from Union Carbide Canada of Willowdale, Ontario, Canada.

The poly(alkylene ester) suitable for the purposes of the present invention has the following general formula:

$$-[O(CH2)_xO-C(O)-(CH2)_y-C(O)-]_n-$$

or $-[O(CH2)_z-C(O)-]_n$ wherein x, y and z is from 1 to about 18 and n is such that the poly(alkylene ester) is in solid form at room temperature. The melting temperature will vary depending on its structure, i.e on the value of x, y and z. Commercially available poly(alkylene esters) are polycaprolactones (z=5) from Union Carbide Canada of Willowdale, Ont., TONE® P767 and TONE® P787. These polymers have a melting point of about 60° C. and have respectively a number average molecular weight of 43,000 and 80,000.

In accordance with the present invention, the polymeric lubricant is used in conjunction with a thermoset or thermoplastic polymeric binder having a strong acid character. Typical thermoset resins are phenolic resins, specifically resoles (one step) or novolacs (two-step). Typical thermoplastic resins are poly(4-vinylphenol) or carboxylic polyacid polymers such as polymethacrylic acid and copolymers, as well as hydrolyzed or monoester maleic anhydride copolymers. Suitable thermoset phenolic resins for these applications are commercially available, for instance, from the Occidental Chemical Corporation: VARCUM® resin series 29217, 29306, 29318, 29338, 7716 and others.

In accordance with the present invention, the polymeric binder and lubricant to form the blend to be admixed with the metal powder, are those that are capable of complexing by intense intermolecular interactions between donors (acid) and acceptors (basic) groups of each polymer, which act like a physical crosslinking. Such intermolecular interactions may happen by intimate mixing of the two polymers during either dissolution, compaction or heat curing of the binder in case of thermoset resins. As well as providing good processability to the metal powders, the binder-lubricant blend improves the green strength of pressed parts. The formation of interpolymer complexes between polymers having strong acceptors and donors groups is well documented in the prior art. For instance, I. A. Katime et al. made a review in The Polymeric Materials Encyclopedia, 1996 (CRC Press, Inc.) on hydrogen-bonded blends, on the detection and characterization of hydrogen bonds and how they affect the properties of the mixtures. U.S. Pat. No. 3,125,544 (Winslow et al.) describes the possibility of forming an association product between a polyether and a phenolic resin. The authors report that, depending on the ratio thermoplastic polyether/thermoset phenolic resin used, tougher thermosets or more rigid thermoplastics can be produced. Such polymeric blends were obtained preferentially by mixing a phenolic resin with an aqueous solution of a polyether, e.g. poly(ethylene oxide). Blending in the melt state using a thermoplastic blending equipment such as an extruder was also described.

The metallurgical powder compositions of the invention can be prepared by various methods. The first method involves dry mixing metallic and alloying powders with the other additives and the polymeric binder and lubricant powders. The second method consists of dissolving the polymeric binder-lubricant blend and spraying the resulting solution on the powder mix in a rotating blender. The solvent is then evaporated under vacuum while heating the blender shell. The third method involves, first, making a dry mix, then spraying a solvent into the mixture while the blender is still rotating. This procedure dissolves partially the binder-lubricant particles, which adhere to the metal particles. The blend is then dried by evaporating the solvent, preferably under vacuum pumping while heating the blender shell. After drying, a free-flowing powder is obtained.

Another alternative is to produce a dry mix of metallic and alloying powders with the other additives and the polymeric binder and lubricant powders and to treat the obtained mix with another polymeric binder in order to improve the flowability, the resistance to dusting and to reduce segregation of the constituents. In this case, a polymeric binder such as polyvinylpyrrolidone dissolved in a solvent is sprayed in the dry mixture, desirably while the blender is still rotating. This procedure desirably binds the fine metal, alloying and binder-lubricant blend particles to the metal particles. Any type of polymeric binder known in the prior art to be suitable to produce segregation-free mixes can be used as for example polyvinylpyrrolidone or polymethacrylate and copolymers.

EXAMPLES

High Green Strength Iron Based Powder Compacts

Example 1

The polymeric binder-lubricant blends comprises a thermoset phenolic resin and a poly(ethylene oxide). Using conventional dry-mixing blenders, different powder mixtures were prepared containing 98.65 wt % ATOMET 1001 steel powder (Quebec Metal Powders Ltd.), 0.6 wt % graphite powder (South Western 1651) and different combinations of phenolic resin and poly(ethylene oxide) powders as described in Table 1. The phenolic resin was a resole-type phenolic resin from Occidental Chemical Corporation (Varcum® 29217). The poly(ethylene oxide) is POLYOX® N-10 from Union Carbide.

Transverse rupture strength bars (3.175×1.270×0.635 cm) were compacted at 65° C. and 45 tsi in a floating compaction die, and ejection pressures were recorded for each mixture. After a curing treatment (1h/175° C. in air), the density and strength (transverse rupture strength according to MPIF 15 Standard) were evaluated. Results are compared in Table 1 with a similar mixture containing the same constituents except that the binder-lubricant of the present invention was replaced by 0.75 wt % of an amide wax lubricant (Atomized ACRAWAX C from Lonza) and no curing was applied.

TABLE 1

| POLYOX N-10 % | Varcum 29217 % | ACRAWAX C % | Ejection Pressure Tsi | Density g/cm$^3$ | TRS psi |
|---|---|---|---|---|---|
| — | — | 0.75 | 2.75 | 7.12 | 2,004 |
| 0.75 | 0 | — | 2.4 | 7.20 | 6,057 |
| 0.65 | 0.1 | — | 2.7 | 7.18 | 10,399 |
| 0.45 | 0.3 | — | 3.0 | 7.16 | 11,127 |
| 0.35 | 0.4 | — | 3.4 | 7.14 | 12,044 |

While maintaining low ejection pressures, the replacement of a part of the polymeric lubricant POLYOX N-10 by the phenolic resin Varcum 29217 enables the production of pressed and cured parts having a much higher mechanical strength than parts containing the polymeric lubricant alone or the conventional amide wax lubricant ACRAWAX C.

Example 2

Two different polymeric binder-lubricant blends are used: phenolic resin—poly(ethylene oxide) blend and phenolic resin—polycaprolactone blend. The thermoset phenolic resin and poly(ethylene oxide) were the same than those used in example 1 and TONE® P767 from Union Carbide was used as the polycaprolactone lubricant. The two blends, consisting of 0.1 wt % of phenolic resin and 0.65 wt % of polymeric lubricant were dissolved in a solvent and mixed with a dry mixture of 98.65 wt % ATOMET 1001 steel powder (Quebec Metal Powders Ltd.) and 0.6 wt % graphite powder (South Western 1651). The mixtures were then dried by evaporating the solvent.

TRS bars were compacted at 65° C. and 45 tsi in a floating compaction die and ejection pressures were recorded for each mixture. After a curing treatment (1h/175° C. in air), the density and strength (TRS) were evaluated. Results are given in Table 2.

TABLE 2

| Varcum ® 29217 % | POLYOX ® N-10 % | TONE ® P767 % | Ejection Pressure tsi | Density g/cm$^3$ | TRS psi |
|---|---|---|---|---|---|
| 0.1 | 0.65 | — | 2.2 | 7.26 | 8,909 |
| 0.1 | — | 0.65 | 3.0 | 7.19 | 13,800 |

Varcum ® 29217: thermoset phenolic resin
POLYOX ® N-10: poly(ethylene oxide)
TONE ® P767: polycaprolactone The results show that even when dissolved in a solvent and coated on the surface of the steel powders, the binder-lubricant blends of the invention produce green parts having significantly higher green strength after curing than comparable prior art compositions, while the ejection pressures are at a low level. The phenolic resin—polycaprolactone blend gave a green strength higher than the phenolic resin—poly (ethylene oxide) blend. This suggests that the basic ester groups of the polycaprolactone, interacting strongly with the acidic phenolic groups of the phenolic resin, adhere more to the surface of the iron particles than the ether groups of the poly(ethylene oxide).

Example 3

Effect of Sintering

Two different materials were pressed and sintered: Mix A containing 98.65% ATOMET 1001+0.6% graphite+0.1% Varcum® 29217 phenolic resin powder+0.65% POLYOX® N-10 powder and a conventional Mix B containing 98.65% ATOMET 1001+0.6% graphite+0.75% Atomized ACRAWAX C.

TRS bars were compacted at 65° C. and 45 tsi in a floating compaction die. After compaction, green compacts made from Mix A were heat treated during one hour in air at 175° C. to cure the phenolic resin. For both Mix A and Mix B, compacts were sintered for 30 minutes at 1120° C. in a dissociated ammonia atmosphere. The density, dimensional change from die size (according to MPIF 44 Standard) as well as the transverse rupture strength (MPIF 41) after sintering were measured. Data are reported in Table 3.

TABLE 3

| Property | Mix A | Mix B |
|---|---|---|
| Green Density (g/cm$^3$) | 7.16 | 7.12 |
| Green Strength (psi) | 9,206 | 2,004 |
| Sintered Density (g/cm$^3$) | 7.13 | 7.09 |
| Dimensional change (%) | 0.26 | 0.25 |
| Sintered Strength (psi) | 105,569 | 99,358 |

As well as increasing the green density and green strength of compacts, the results show that the use of the polymeric binder-lubricant blend of the invention (Mix A) gives sintered parts with properties equivalent of better than those of parts made from mixes containing a conventional ACRAWAX C lubricant (Mix B).

The good sintered properties obtained by using the polymeric blend of the invention may be attributed to the formation of the interpolymer complex between the polymeric lubricant and polymeric binder that minimizes dimensional change during sintering.

Soft Magnetic Iron/Resin Composites

Example 4

Soft magnetic iron/resin composites using only a phenolic resin as binder exhibit good mechanical and magnetic properties, but they necessitate lubrication of the die walls during compaction of parts. The use of a polymeric lubricant such as polyethylene oxide in conjunction with a phenolic resin improves the processability of such soft magnetic composites, while maintaining good performance properties.

Using conventional dry-mixing blenders, two different powder mixtures were prepared containing 99.2 wt % ATOMET 1001 HP (High Purity powder manufactured by Quebec Metal Powders Ltd.) and either 0.8% of phenolic resin or 0.4 wt % /0.4 wt % of phenolic resin/poly(ethylene oxide) powders. The phenolic resin was a resole-type phenolic resin from Occidental Chemical Corporation (Varcum® 29217). The poly(ethylene oxide) was POLYOX® N-10 from Union Carbide.

TRS bars were compacted at 65° C. and 45 tsi in a floating compaction die and ejection pressures were determined. After a curing treatment (1h/175° C. in air), the density and transverse rupture strengths were evaluated. Results are given in Table 4.

TABLE 4

| POLYOX | Varcum | | Ejection | Before curing | | After curing | |
|---|---|---|---|---|---|---|---|
| ® N-10 % | ® 29217 % | Die wall lubrication | Pressure tsi | Density g/cm$^3$ | TRS psi | Density g/cm$^3$ | TRS psi |
| 0 | 0.8 | No | 4.6 | 7.14 | 3,196 | 7.14 | 16,319 |
| 0 | 0.8 | Yes | 2.4 | 7.17 | — | 7.16 | 17,607 |
| 0.4 | 0.4 | No | 2.9 | 7.27 | 5,471 | 7.27 | 14,178 |

Even if the strength after curing is slightly reduced compared to a mix containing 0.8% phenolic resin, the mix containing 0.4% phenolic resin/0.4% POLYOX® N-10 gives a low ejection pressure and is therefore effective to improve processing of parts without the need of die-wall lubrication. This binder-lubricant blend enables pressing of parts with a very high density while maintaining good mechanical properties. As described previously, the high strength results from the intense intermolecular reaction that occurs between the phenolic resin and the poly(ethylene oxide) polymers admixed with the metal powder. Indeed, infrared measurements revealed the existence of strong hydrogen bonds between hydroxyl phenolic groups of the phenolic resin and ether groups of the poly(ethylene oxide) polymer.

Example 5

Comparison of Different Phenolic Resin/Lubricant Systems

Soft magnetic iron/resin composites were produced with different phenolic resin—lubricant blends. The resole-type phenolic resin VARCUM®29217 from Occidental Chemical Corporation was used in conjonction with three different lubricants: Poly(ethylene oxide) POLYOX®N-10 from Union Carbide, lithium stearate (Li-St) from Blachford Inc. and Polytetrafluoroethylene (PTFE) S-5742 from Shamrock Technologies.

Using conventional dry-mixing blenders, three different powder mixtures were prepared containing 99.1 wt % ATOMET 1001HP (High Purity iron powder manufactured by Quebec Metal Powders Ltd.), 0.6 wt % of phenolic resin powder and 0.3 wt % of poly(ethylene oxide) or lithium stearate or polytetrafluoroethylene powders as described in Table 5. TRS bars were compacted at 65° C. and 45 tsi in a floating compaction die. After a heat treatment (1h/175° C. in air), the density and transverse rupture strengths were evaluated.

TABLE 5

| Binder 0.6% wt | Lubricant 0.3% wt | Density g/cm$^3$ | TRS psi |
|---|---|---|---|
| phenolic resin | PTFE | 7.17 | 12,220 |
| phenolic resin | Li-St | 7.15 | 7,700 |
| phenolic resin | POLYOX N-10 | 7.20 | 14,890 |

Results in Table 5 show that the polymeric binder-lubricant blend of the present invention gives soft magnetic composites with the highest density and strength. Inferior properties are obtained when using other conventional lubricants such as polytetrafluoroethylene or lithium stearate in conjonction with the same phenolic resin.

Example 6

Magnetic Properties

Using the mixtures described in Example 4, rings were compacted at 45 tsi and 65° C. in order to measure the magnetic properties of the composites at frequencies of 60 and 400 Hz and a magnetization of 0.5 Tesla. The results are shown in Table 6.

TABLE 6

| POLYOX ® N-10 % | Varcum ® 29217 % | Density g/cm$^3$ | Frequency Hz | Permeability $\mu$ | Core Loss W/lb |
|---|---|---|---|---|---|
| 0.4 | 0.4 | 7.29 | 60 | 541 | 1.6 |
| | | | 400 | 533 | 10.9 |
| 0 | 0.8 | 7.20 | 60 | 394 | 1.6 |
| | | | 400 | 389 | 11.8 |

* Magnetization of 0.5 Tesla

Besides improving the processability of parts, the polymeric binder-lubricant blend of the present invention (0.4% Varcum®29217/0.4% POLYOX® N-10) enables the production of iron/resin parts with similar or better magnetic properties (permeability and core losses) than those obtained using the binder phenolic resin alone (0.8% Varcum®29217). The improvement of the magnetic properties may be explained by the increase in density of parts pressed from the mix containing the polymeric binder-lubricant blend of the invention. Indeed, it is known that the permeability is strongly influenced by the effective length of distributed air-gaps in soft magnetic iron/resin compacts which is related to the density.

We claim:

1. A metallurgical powder composition containing a metallic powder and a polymeric blend comprising a binder and lubricant, the amount of the polymeric blend being from about 0.1 wt % to about 20 wt % of the composition, the binder and the lubricant being selected such that they form an interpolymer complex by intermolecular hydrogen interactions when mixed with each other.

2. The powder composition according to claim 1 wherein said metallic powder is a ferrous powder, the composition further comprising an alloying powder in the amount of up to 15 wt % of said composition, said alloying powder selected from the group consisting of copper, nickel, graphite and ferro-alloys.

3. The powder composition according to claim 1 wherein said binder has a strong acid character.

4. The powder composition according to claim 3 wherein said binder is a thermoset phenolic resin.

5. The powder composition according to claim 3 wherein said binder is a thermoplastic polymer.

6. The powder composition according to claim 5 wherein said binder is a poly(4-vinylphenol) or a carboxylic polyacid.

7. The powder composition according to claim 1 wherein said polymeric lubricant is a poly(alkylene oxide) having the general formula $$—[O(CH_2)_x]_y—$$

where x is from 1 to about 7 and y is selected such that the poly(alkylene oxide) has a weight average molecular weight greater than 5,000.

8. The powder composition according to claim 7 wherein said polymeric lubricant is a poly(ethylene oxide) having the formula $$—[O—CH_2—CH_2]_y—$$

9. The powder composition according to claim 1 wherein said polymeric lubricant is a poly(alkylene ester) having more than one sub-unit having the formula $$—[O(CH2)_xO—C(O)—(CH2)_y—C(O)—]_n—$$

where x, y or z is from 1 to about 18 and n is such that said poly(alkylene ester) is solid at room temperature.

10. The powder composition according to claim 1 wherein said polymeric lubricant is a poly(alkylene ester) having more than one unit having the general formula $$—[O(CH2)_z—C(O)—]_n$$

where x, y or z is from 1 to about 18 and n is such that said poly(alkylene ester) is solid at room temperature.

11. The powder composition according to claim 10 wherein said lubricant is a polycaprolactone having a number average molecular weight from about 43,000 to about 80,000.

12. The powder composition according to claim 7 wherein said poly(alkylene oxide) has a weight average molecular weight from about 5,000 to about 8,000,000.

13. The powder composition according to claim 7 wherein said poly(alkylene oxide) has a weight average molecular weight from about 5,000 to about 400,000.

14. The powder composition according to claim 1 wherein the content of said blend is from about 0.1 wt % to about 5 wt % of said composition.

15. The powder composition according to claim 1 wherein the maximum particle size of said metallic powder is not more than about 600 $\mu$m.

16. The powder composition according to claim 1 wherein said binder is a phenolic resin.

17. The powder composition according to claim 1 wherein the strength of said composition, when compacted, exceeds 5,000 psi.

18. The powder composition according to claim 1 wherein the strength of said composition, when compacted, exceeds 8,000 psi.

* * * * *